US007419148B1

(12) United States Patent
Jones et al.

(10) Patent No.: US 7,419,148 B1
(45) Date of Patent: Sep. 2, 2008

(54) VARIABLE ANGLE FLEXIBLE BAND CLAMP CORNER

(75) Inventors: Steven K. Jones, Ottawa (CA); Scott T. Roger, Ottawa (CA)

(73) Assignee: Lee Valley Tools, Ltd., Ottawa, ON (CA)

( * ) Notice: Subject to any disclaimer, the term of this patent is extended or adjusted under 35 U.S.C. 154(b) by 77 days.

(21) Appl. No.: 11/252,288

(22) Filed: Oct. 17, 2005

Related U.S. Application Data

(60) Provisional application No. 60/620,254, filed on Oct. 19, 2004.

(51) Int. Cl.
*B25B 1/20* (2006.01)

(52) U.S. Cl. ..... 269/42; 269/95

(58) Field of Classification Search ..... 269/42, 269/43, 21, 95, 73
See application file for complete search history.

(56) References Cited

U.S. PATENT DOCUMENTS

| | | | | | |
|---|---|---|---|---|---|
| 442,934 | A | | 12/1890 | Ackerman | |
| 633,657 | A | | 9/1899 | Muller | |
| 720,816 | A | | 2/1903 | Karl | |
| 891,121 | A | | 6/1908 | Wichers | |
| 1,053,556 | A | | 2/1913 | Bergstrom | |
| 1,770,763 | A | | 7/1930 | Wolfstyn | |
| 2,696,232 | A | | 12/1954 | Johnson | |
| 3,584,860 | A | | 6/1971 | Ervin | |
| 3,908,850 | A | * | 9/1975 | Jureit et al. | 217/70 |
| 4,163,547 | A | * | 8/1979 | Jerome | 269/42 |
| 4,171,799 | A | | 10/1979 | Elko | |
| D260,340 | S | * | 8/1981 | Hardy | D6/491 |
| 4,527,784 | A | * | 7/1985 | Schwab | 269/42 |
| 4,560,153 | A | | 12/1985 | Han | |
| 4,938,357 | A | * | 7/1990 | Schmidt | 206/453 |
| D312,783 | S | * | 12/1990 | Sharp | D9/434 |
| 5,161,789 | A | * | 11/1992 | Rogers | 269/42 |
| 5,311,996 | A | * | 5/1994 | Duffy et al. | 206/453 |
| 5,689,864 | A | * | 11/1997 | White | 24/514 |
| 5,704,599 | A | * | 1/1998 | Slothower | 269/21 |
| 5,918,866 | A | * | 7/1999 | Klimach | 269/3 |
| 5,992,836 | A | * | 11/1999 | Howe | 269/41 |
| D427,893 | S | * | 7/2000 | Lappin et al. | D8/382 |

(Continued)

FOREIGN PATENT DOCUMENTS

| | | |
|---|---|---|
| CH | 152655 | 2/1932 |

(Continued)

*Primary Examiner*—Lee D Wilson
(74) *Attorney, Agent, or Firm*—Kilpatrick Stockton LLP; John S. Pratt; Camilla C. Williams

(57) ABSTRACT

A variable angle flexible band clamping corner for clamping work piece angles in desired locations to permit nailing, screwing, gluing, or otherwise joining the work pieces. The clamping corner consists of two pivotable contact pads, where the face of each contact pad extends on both sides of the face of the other contact pad. The contact pads can be either constant width fingers that bypass each other when pivoting, or a wide pad with thinner fingers extending from the pad, where the fingers interleave with each other. A corner formed by two work pieces positioned between the two contact pads remains aligned by the force of the face of each contact pad. The clamping corner includes a body that receives force and transmits the force to the contact pads which hold the work piece corner in place.

15 Claims, 6 Drawing Sheets

U.S. PATENT DOCUMENTS

| | | | | |
|---|---|---|---|---|
| 6,279,885 | B1 * | 8/2001 | Leon, Jr. | 269/8 |
| D455,266 | S * | 4/2002 | Bradford | D3/318 |
| 6,391,144 | B1 * | 5/2002 | Gilbert, Jr. | 156/304.1 |
| 6,427,993 | B1 * | 8/2002 | Prochac | 269/37 |
| D496,853 | S * | 10/2004 | Jones | D8/394 |
| 7,168,693 | B1 * | 1/2007 | Sjuts et al. | 269/37 |

FOREIGN PATENT DOCUMENTS

| | | | |
|---|---|---|---|
| DE | 181133 | | 2/1907 |
| DE | 8511115 | | 9/1985 |
| EP | 0346721 | A2 | 12/1989 |
| FR | 717381 | | 1/1932 |
| GB | 1006056 | | 9/1965 |
| WO | WO82/03041 | | 9/1982 |

* cited by examiner

VARIABLE ANGLE FLEXIBLE BAND CLAMP CORNER

CROSS REFERENCE TO RELATED APPLICATIONS

This application claims priority to U.S. Provisional Patent Application Ser. No. 60/620,254 filed Oct. 19, 2004 entitled "Variable Angle Flexible Band Clamp Corner," which is incorporated herein by reference.

FIELD OF THE INVENTION

This invention relates to devices and techniques for clamping work pieces in desired locations to permit nailing, screwing or gluing the work pieces, and, more particularly, relates to corners used with flexible band clamps to transmit force to the work pieces during clamping operations.

BACKGROUND OF THE INVENTION

It is often desirable to clamp two work pieces together. For example, rectangular picture frames are made from four work pieces cut in a bevel at both ends, and the beveled ends of two work pieces fit together to form a frame corner. Each frame corner is held together by a fastener and or adhesive, and the frame corners must be clamped while the adhesive dries or the fastener is installed. Other situations involving clamping work pieces together include window frame assembly and furniture construction. With any of these examples, it is important to avoid work piece misalignment. Another consideration is proper clamping of corners having acute or obtuse angles. Many times the corner will form a 90° angle, as in a rectangular picture frame or window frame. But sometimes it is desirable to construct a frame with other angles. For example, some windows have octagon shapes where the work piece corners form obtuse angles. Therefore, it is desirable to provide a clamping device that can be used to firmly and accurately clamp work piece corners having a variety of angles.

Clamping corners are known in a wide range of structural designs. It is well known in the art that work piece corners can be clamped with rigid sleeves as taught by U.S. Pat. No. 4,527,784. These rigid sleeves slide over the work piece corner and clamp down on the top and bottom surfaces of the work pieces. These devices are unable to adapt to work piece corners having a variety of angles, however. Each rigid sleeve has a particular angle and will not fit onto work piece corners having a different angle. It is therefore desirable to provide a clamping corner that can adapt to work piece corners with varying angles.

Another design well known in the art is a clamping corner with pivotable pads as taught by U.S. Pat. No. 891,121. These clamps can adapt to work piece corners having angles other than 90° because they have pivotable pressure surfaces. These devices do not prevent the work piece corners from misaligning, however. The pivotable pressure surfaces are typically separated by a gap that allows the work pieces to shift relative to one another, thus misaligning the corner. It is therefore desirable to provide a clamping corner device that will prevent misalignment of the work piece corner.

SUMMARY OF THE INVENTION

The clamping corner of this invention provides contact pads to secure two work pieces in a corner. The contact pads pivot to accommodate work piece corners having angles other than 90°. In addition, the contact pads prevent work piece misalignment by providing contact extending beyond each of the work piece ends forming a corner. The contact pads interleave with each other, thus allowing the face of each contact pad to extend on both sides of the face of the other pad. When the two work pieces are positioned between the contact pads, each pad stops or prevents extension of the end of one work piece beyond the plane of the outside surface of the other work piece. Together, the two pads thereby force the two work pieces into proper alignment.

It is thus an object of this invention to provide an improved clamping corner. The clamping corner of this invention can clamp 90° and other angles formed by two work pieces.

It is another object of this invention to provide a clamping corner that will prevent misalignment of work pieces.

These and other benefits of this invention may be understood by reference to the following drawings, the description set forth below, and the claims.

DETAILED DESCRIPTION OF THE DRAWINGS

Figure 1:
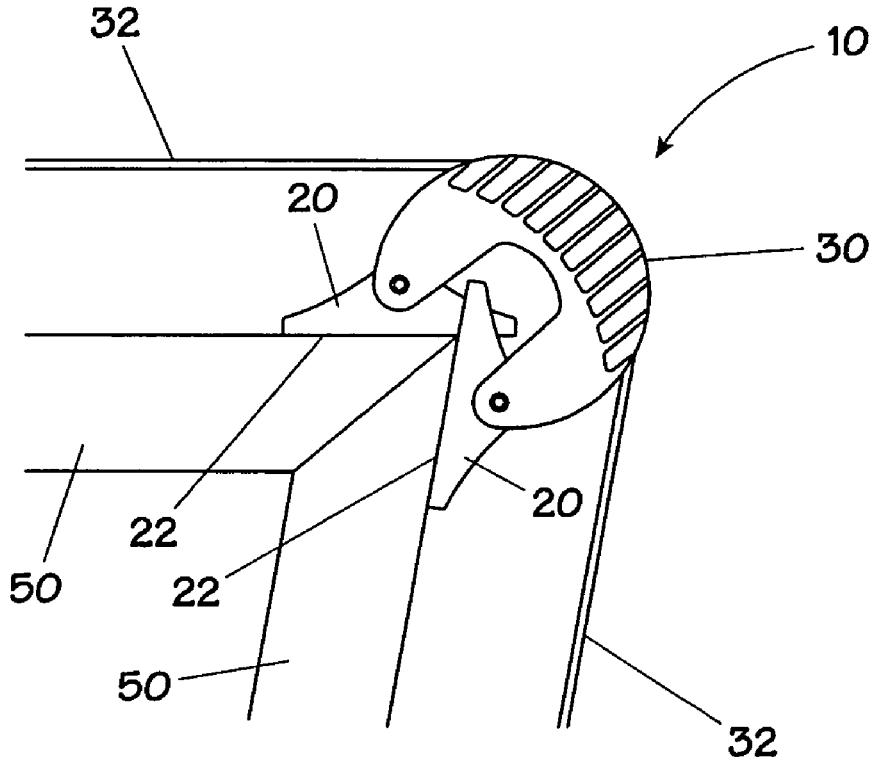
FIG. 1 is a side view showing an embodiment of the clamping corner of this invention positioned on a work piece corner.
Figure 2:
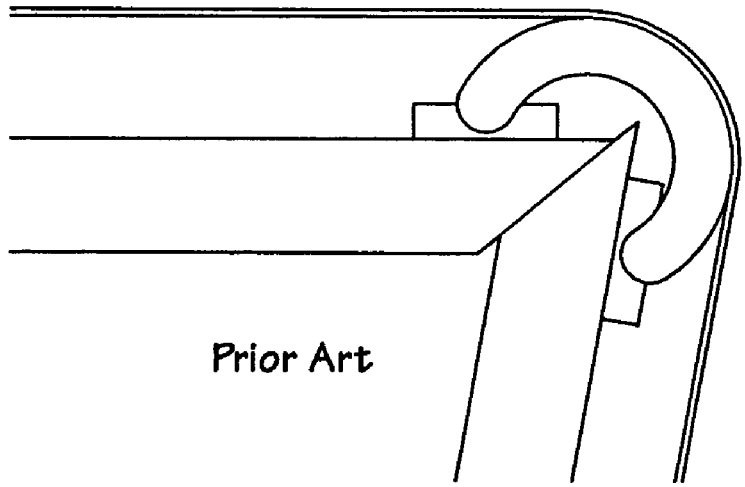
FIG. 2 is a side view showing a prior art clamping corner.

As will be appreciated by reference to the figures, the clamping corner 10 of this invention includes contact pads 20 and a body 30. The contact pads 20 are positioned so that the faces 22 intersect, and the face 22 of each contact pad 20 extends on both sides of the face 22 of the other contact pad 20. As illustrated in FIG. 1, this positioning causes a portion of each contact pad 20 to extend beyond the outside surface of a work piece 50. The extending portion of the contact pad 20 insures that the end of the work piece 50 lying against the other contact pad 20 does not slip out of its proper position relative to the other work piece 50 to which it is being joined. FIG. 2 shows a view of a prior art clamping corner without contact pads with intersecting faces, where the work piece corner is misaligned.

Figure 3:
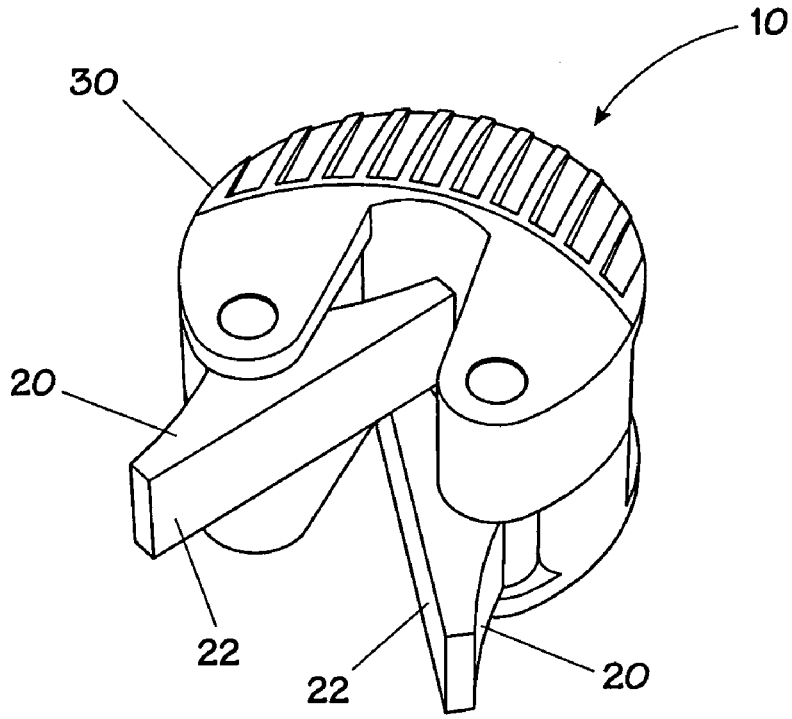
FIG. 3 is a perspective view of one embodiment of the clamping corner of the invention with contact pads positioned to bypass each other when pivoting.
Figure 4:
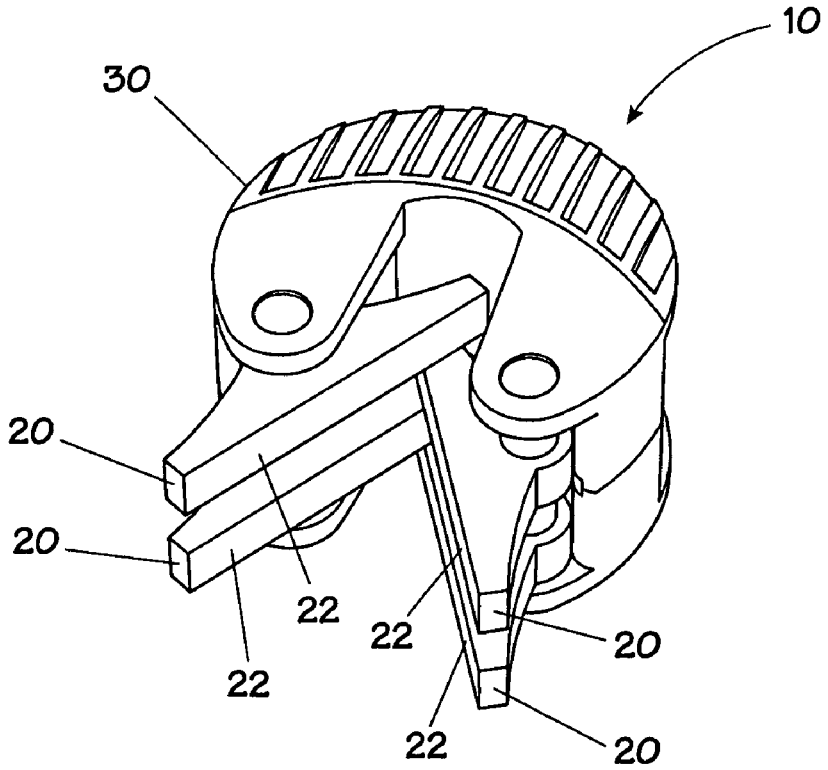
FIG. 4 is a perspective view of another embodiment of the clamping corner of this invention with two pairs of contact pads positioned to bypass each other when pivoting.
Figure 5:
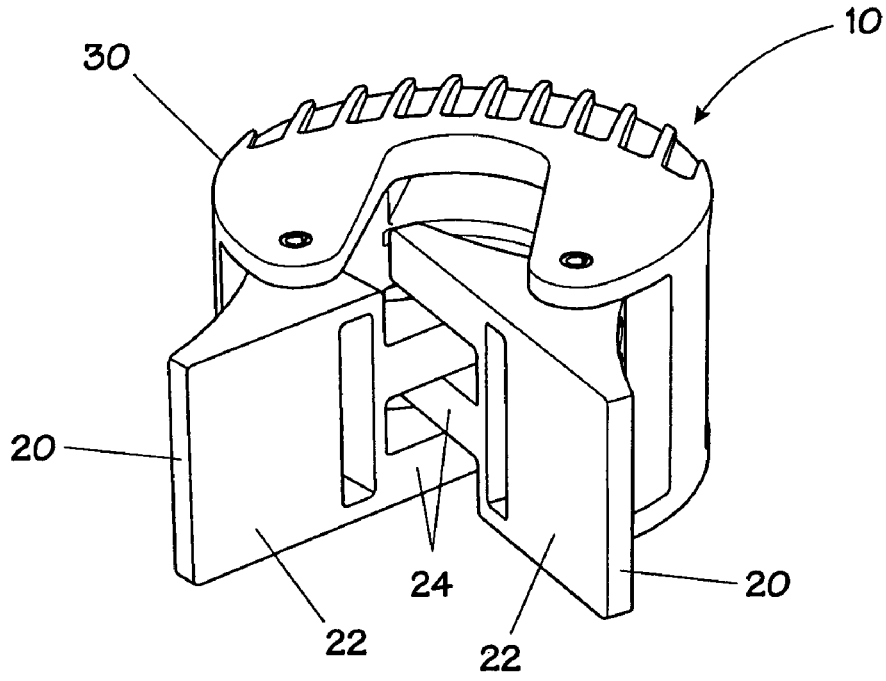
FIG. 5 is a perspective view of another embodiment of the clamping corner of this invention with interleaving contact pad fingers.

The contact pads 20 can have the same width throughout their lengths, as shown in FIG. 3. In this embodiment, the two contact pads 20 are positioned to bypass each other when pivoting. One drawback to this embodiment is that the work pieces tend to twist within the clamping corner 10. An improved structure can be provided by adding contact pads 20 to the clamping corner 10, as illustrated in FIG. 4. In this embodiment, the additional contact pad(s) 20 are placed directly above or below the last contact pad 20. Alternatively, in the embodiment shown in FIG. 5 the contact pads 20 can have fingers 24 that extend from a wider contact pad 20. The fingers 24 of one contact pad 20 interleave with the fingers 24 of the other contact pad 20 so that each finger's face 22 extends on both sides of the face 22 of the other finger 24.

Figure 6:
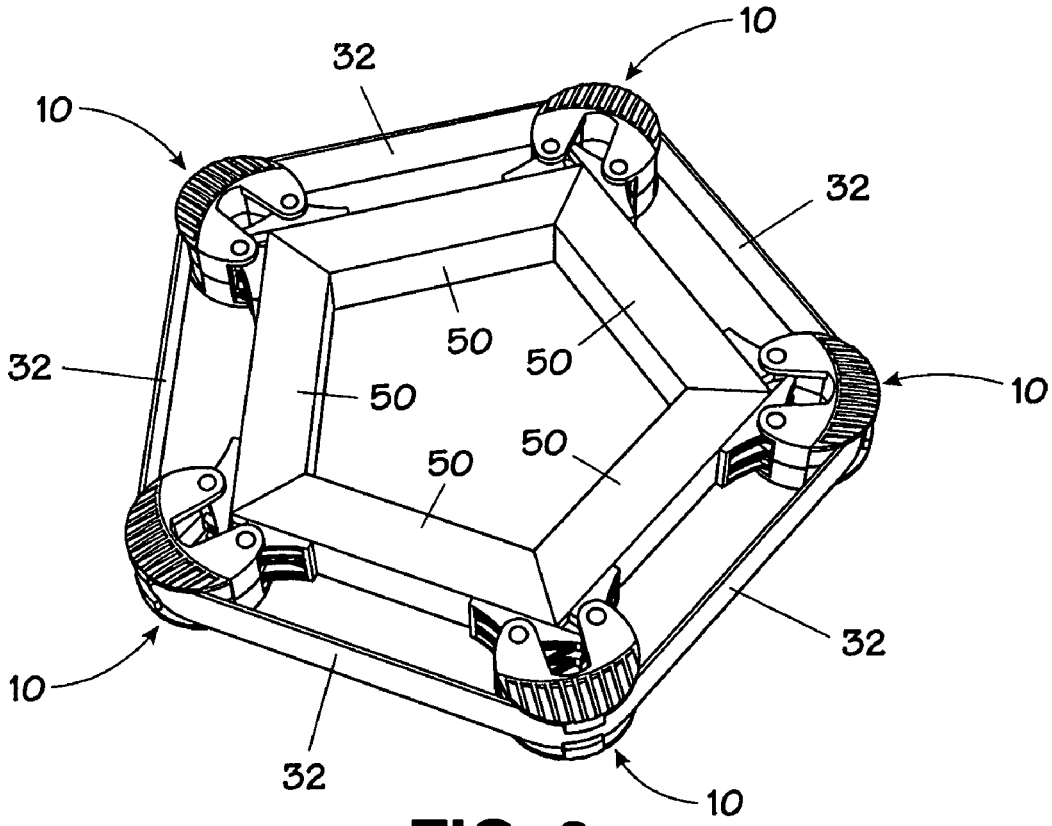
FIG. 6 is a side view of five clamping corners of this invention positioned on a five-sided frame.
Figure 7:
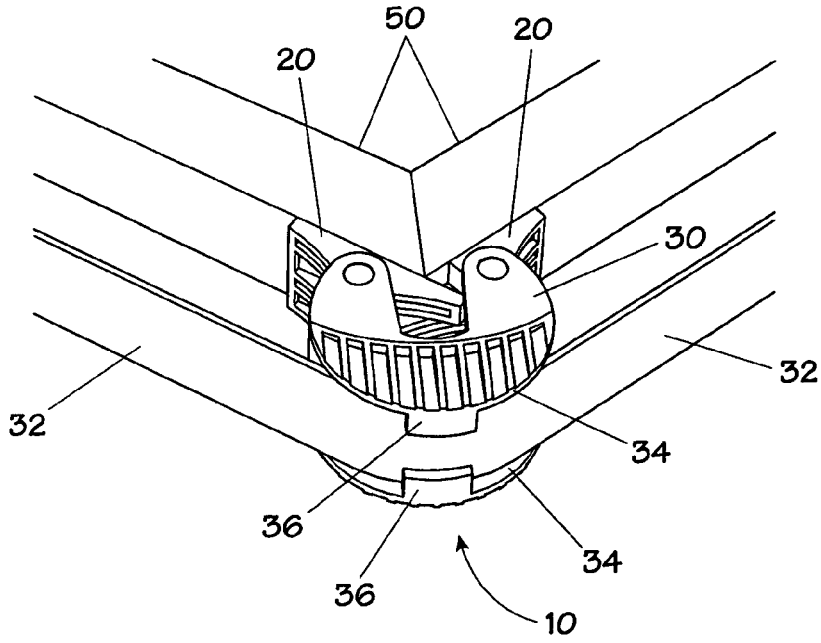
FIG. 7 is a perspective view of one embodiment of the clamping corner of this invention showing flanges and tabs on the body.

In use, at least as many clamping corners 10 will be needed as there are angles in the construction, as shown in FIG. 6. A clamp band 32 can be wrapped around each clamping corner 10 to form a loop, and the user can apply force to tighten the loop. The body 30 receives the force from the clamp band 32 and transmits the force to the contact pads 20, which securely apply pressure on the work pieces 50. In the embodiment shown in FIG. 7, the body includes flanges 34 and tabs 36 to position and retain the clamp band 32. Alternatively, force can be applied to the body 30 by a clamp, cable, elastic band, or in any other appropriate manner.

Figure 8:
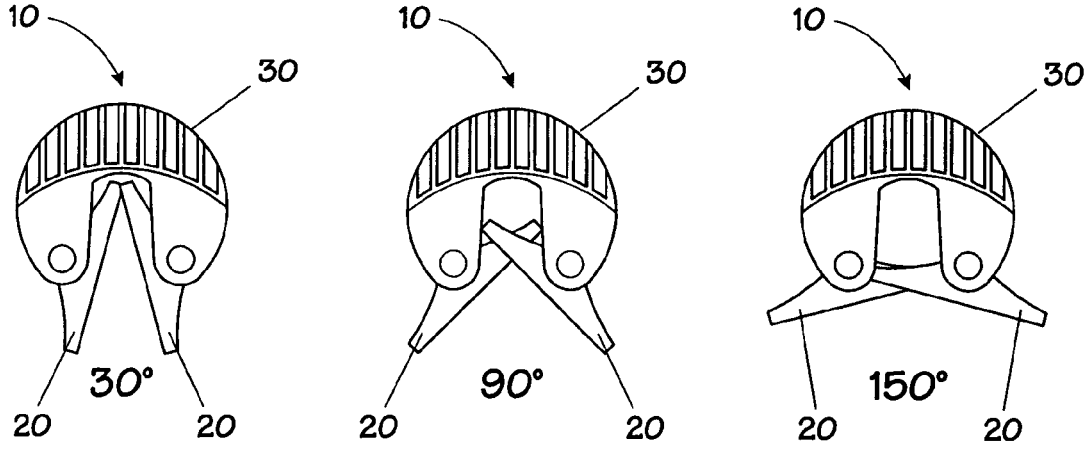
FIG. 8 is a series of side views of the clamping corner shown in FIG. 7 where each view shows a different contact pad position.
Figure 9:
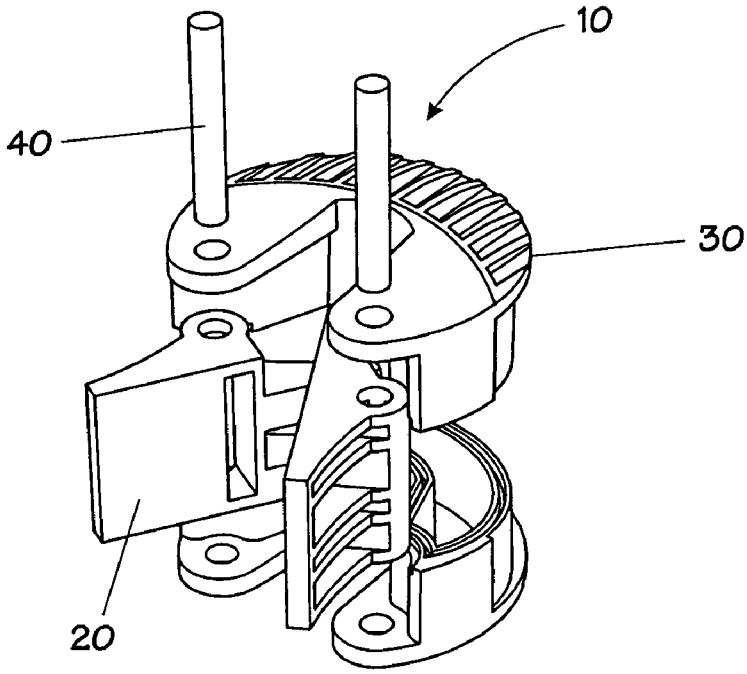
FIG. 9 is a perspective view of one embodiment of the clamping corner of this invention in which the contact pads pivot on a pin.
Figure 10:
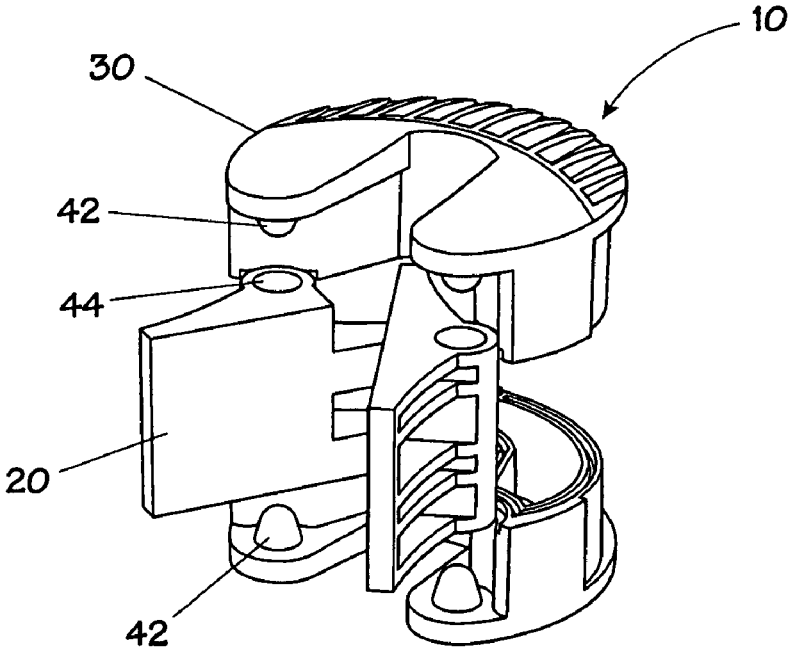
FIG. 10 is a perspective view of another embodiment of the clamping corner of this invention in which the contact pads pivot on protrusions.
Figure 11:
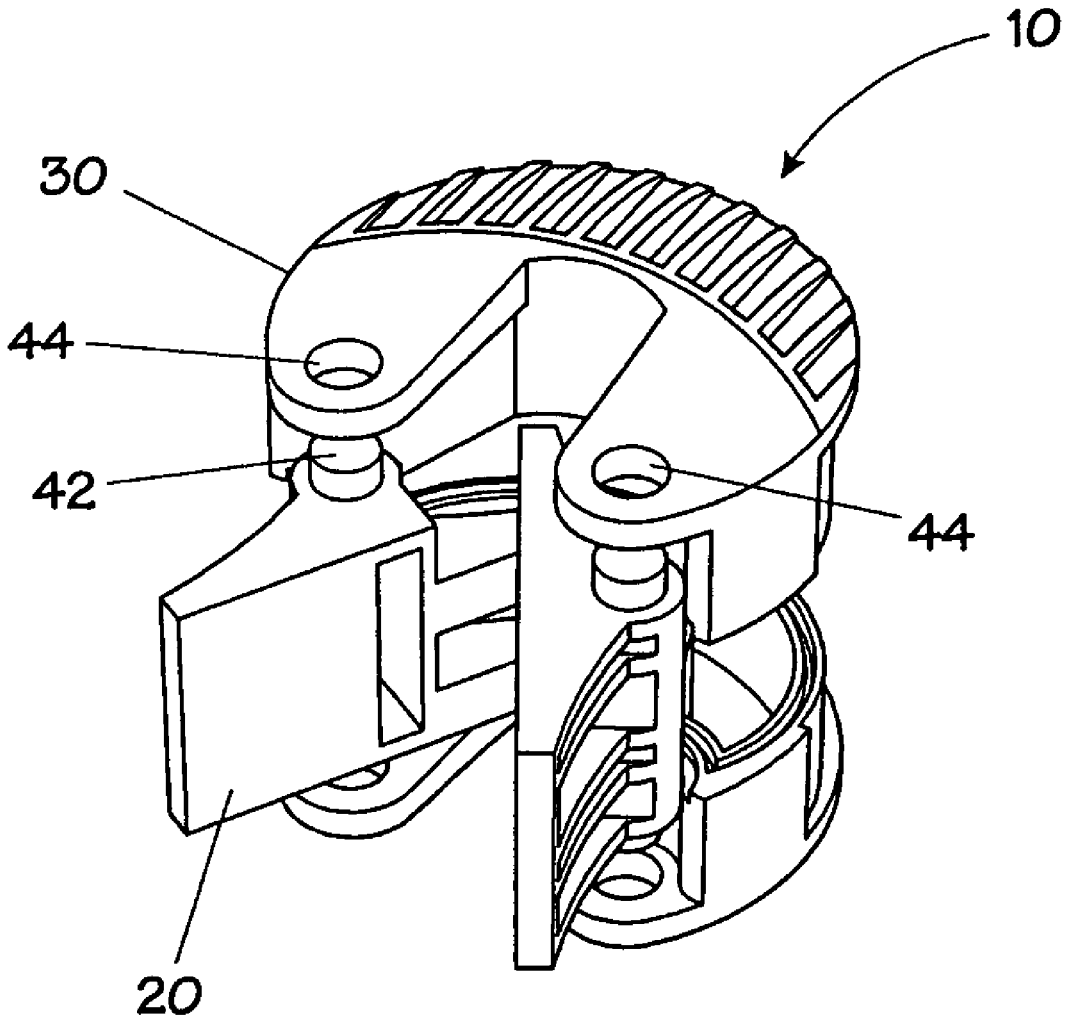
FIG. 11 is a perspective view of yet another embodiment of the clamping corner of this invention in which the contact pads pivot on recesses.

In the embodiment shown in FIG. 8, the contact pads 20 can pivot between angles of 30-150°. As illustrated in FIGS. 9-11, the contact pads 20 can pivot on pins 40 positioned in the body 30, or on protrusions 42 in the body 30 received by recesses 22 in the contact pads 20, or on protrusions 42 in the contact pads 20 received in recesses 44 in the body 30. These and other pivot configurations are contemplated by the clamping corner 10 of this invention.

The components of clamping corner 10 of this invention, including the contact pads 20, body 30, and all the components integrated therein can be molded of glass filled nylon or another suitable strong material such as polycarbonate. The clamp band 32 can be woven nylon or another textile material, or formed from different types of plastic. Each component can be made of a number of alternative materials, in a variety of shapes, and in a number of sizes without departing from the scope and spirit of this invention or the scope of the claims set forth below.

The invention claimed is:

1. A clamping corner assembly for clamping two work pieces utilizing a flexible band, comprising:

(a) a flexible band; and (b) a clamping corner comprising:

(i) two pivoting contact pads, each having a face extending on both sides of the face of the other pad; and (ii) a body attached to the contact pads to receive a force from the flexible band and transmit a the force to the contact pads, the body having at least one flange to position the flexible band.

2. A clamping corner assembly as in claim 1, where the contact pads are positioned to bypass each other when pivoting.

3. A clamping corner assembly as in claim 2, further comprising additional contact pads-positioned to bypass each other when pivoting.

4. A clamping corner assembly as in claim 1, wherein the body receives a corner formed by two work pieces, and the face of each contact pad stops the extension of a work piece.

5. A clamping corner assembly as in claim 1, where the contact pads can pivot between acute and obtuse angles.

6. A clamping corner assembly as in claim 1, where the contact pads pivot on pins passing through the body.

7. A clamping corner assembly as in claim 1, where the contact pads pivot on protrusions or recesses defined by the body.

8. A clamping corner assembly for clamping two work pieces using a flexible clamp band, comprising:

(a) a flexible band; and (b) a clamping conrner comprising: (i) two pivoting contact pads; (ii) at least one finger extending from each contact pad and interleaving with the finger of the other contact pad; and (iii) a body attached to the contact pads to receive and transmit force to the contact pads from the clamp band with the band wrapped around a portion of the body by exerting force on the band.

9. A clamping corner assembly as in claim 8, where each finger on one contact pad has a face that extends on both sides of the face of the finger on the other contact pad.

10. A clamping corner assembly as in claim 9, further comprising additional fingers extending from each contact pad that interleave with the fingers of the other contact pad.

11. A clamping corner assembly as in claim 8, wherein the body receives a corner formed by two work pieces, and the face of each finger stops the extension of a work piece.

12. A clamping corner assembly as in claim 8, where the contact pads can pivot between acute and obtuse angles.

13. A clamping corner assembly as in claim 8, where the contact pads pivot on pins passing through the body.

14. A clamping corner assembly as in claim 8, where the contact pads pivot on protrusions or recesses defined by the body.

15. A set of at least three clamping corner assemblies for clamping work pieces using a band encircling the clamping corners and work pieces, each clamping corner assembly comprising:

a) a band; and b) a clamping corner comprising:

(i) a plastic clamp body having two pairs of arms extending from an arcuate band-receiving portion against which the band lies and applies force during use of the clamp, and (ii) pivotably positioned between each pair of arms, a plastic clamping pad having at least one finger positioned to interleave with at least one finger of the other clamping pad when the pads pivot.

* * * * *